US012245672B2

(12) United States Patent
Osachuk

(10) Patent No.: US 12,245,672 B2
(45) Date of Patent: Mar. 11, 2025

(54) REMOVABLE SLEEVE TO PROTECT SHOULDER STRAPS OF A BACKPACK

(71) Applicant: Brittany Osachuk, Leominster, MA (US)

(72) Inventor: Brittany Osachuk, Leominster, MA (US)

( * ) Notice: Subject to any disclaimer, the term of this patent is extended or adjusted under 35 U.S.C. 154(b) by 0 days.

(21) Appl. No.: 17/732,130

(22) Filed: Apr. 28, 2022

(65) Prior Publication Data

US 2023/0165350 A1 Jun. 1, 2023

Related U.S. Application Data

(60) Provisional application No. 63/283,898, filed on Nov. 29, 2021.

(51) Int. Cl.
*A45C 13/30* (2006.01)
*A45F 3/04* (2006.01)
*A45F 3/00* (2006.01)

(52) U.S. Cl.
CPC ..... *A45C 13/30* (2013.01); *A45F 3/04* (2013.01); *A45F 2003/001* (2013.01)

(58) Field of Classification Search
CPC ..... A45F 2003/001; A45F 2003/122; A45F 2003/142; A45F 3/04; A45F 3/12; A45C 13/001; A45C 13/30; A63B 55/408
USPC ..... 224/257
See application file for complete search history.

(56) References Cited

U.S. PATENT DOCUMENTS 5,009,346 A * 4/1991 Butler ..... A45F 5/02 206/229
5,566,871 A * 10/1996 Weintraub ..... A45F 3/12 224/264
8,813,402 B2 * 8/2014 Ponce ..... A45F 3/00 190/102
2007/0205237 A1 * 9/2007 Machens ..... A01D 34/902 224/264
2009/0072563 A1 * 3/2009 Phillips ..... A45F 3/12 294/149

(Continued)

FOREIGN PATENT DOCUMENTS

JP 3107696 U * 9/2004
KR 200446061 Y1 * 9/2009
WO WO-2023096983 A1 6/2023

OTHER PUBLICATIONS

KR 200446061 Y1 Translation, 박정수 . Sep. 2009 (Year: 2009).*

(Continued)

*Primary Examiner* — Nathan J Newhouse
*Assistant Examiner* — Matthew T Theis
(74) *Attorney, Agent, or Firm* — COOLEY LLP

(57) ABSTRACT

An apparatus for attachment to a backpack includes an elongate fabric sleeve having a length of between about 16 inches and about 20 inches, and including an opening through which a sternum strap of the backpack extends during use. The elongate fabric sleeve can be removably secured to a shoulder strap of a backpack, and can be positioned about an entire circumference of the shoulder strap such that the fabric sleeve covers the shoulder strap along a length of the shoulder strap between a first end portion of the shoulder strap and a second, opposite end portion of the shoulder strap.

20 Claims, 4 Drawing Sheets

(56) References Cited

U.S. PATENT DOCUMENTS

| | | | | |
|---|---|---|---|---|
| 2011/0049950 | A1* | 3/2011 | Pereira | B60N 2/2881 297/219.12 |
| 2014/0263498 | A1* | 9/2014 | Flem | A45F 3/047 224/259 |
| 2023/0284771 | A1* | 9/2023 | Lindemann | A45F 3/14 |

OTHER PUBLICATIONS

Rice, Wanda "How to Add Extra Padding to Backpack Shoulder Straps", SectionHiker.com, May 9, 2021, 2 pages. Retrieved online: https://sectionhiker.com/how-to-add-extra-padding-to-backpack-shoulder-straps/.

International Search Report and Written Opinion for International Application No. PCT/US2022/050883 dated Jan. 19, 2023, 10 pages.

International Preliminary Report on Patentability for International Application No. PCT/US2022/050883, dated Jun. 13, 2024, 9 pages.

* cited by examiner

200

202

200

400

400

REMOVABLE SLEEVE TO PROTECT SHOULDER STRAPS OF A BACKPACK

CROSS REFERENCE TO RELATED APPLICATION

This application claims priority to and the benefit of U.S. Provisional Patent Application No. 63/283,898, filed Nov. 29, 2021 and titled "REMOVABLE SLEEVE TO PROTECT SHOULDER STRAPS OF A BACKPACK", the contents of which are incorporated by reference in its entirety herein.

FIELD

In one or more embodiments, a removable sleeve is configured to cover at least a portion of a shoulder strap of a backpack to protect the shoulder strap.

BACKGROUND

Hikers often use backpacks. Though backpacks can be useful, they are not without their problems. For example, hiking backpacks can be bulky and heavy. As a result, it can often be a hassle retrieving items stored in the backpack, as the backpack wearer typically needs to take off their backpack.

As another example, some hikers prefer to hike with their arms, and/or shoulders exposed (e.g., wearing a tank top or thin shirt, shirtless) on warmer days. This can often cause sweat and/or deodorant to be transferred onto the shoulder straps. As a result, backpacks may need frequent cleanings even when only certain portions of the backpack are dirty. Not only does this waste energy and water, but frequently cleaning a backpack can decrease the lifespan of the backpack and/or cause the backpack to look worn out. As one example, washing/drying the backpack can wear out the fabric and can make it look old. Other times, washing/drying a backpack can create frills, which can get caught in zippers during the closure of the zippers.

Washing and/or drying a backpack can also have further issues for special types of backpacks. For instance, a single washing of a waterproof backpack can cause the waterproof layer to come off. As another example, smart-backpacks, which often include circuitry (e.g., to charge a hiker's phone), can be damaged if washed.

SUMMARY

In some embodiments, an apparatus for attachment to a backpack comprises an elongate fabric sleeve having a length of between about 16 inches and about 20 inches and an opening through which a sternum strap of the backpack extends during use. The elongate fabric sleeve is configured to be removably secured to a shoulder strap of a backpack. The elongate fabric sleeve is configured to be positioned about an entire circumference of the shoulder strap such that the fabric sleeve covers the shoulder strap along a length of the shoulder strap between a first end portion of the shoulder strap and a second end portion of the shoulder strap opposite the first end portion of the shoulder strap.

In some embodiments, an apparatus comprises a backpack including a first shoulder strap and a second shoulder strap. The apparatus also comprises a first sleeve having a length of between about 16 inches and about 20 inches, where the first sleeve is configured to be removably secured to the first shoulder strap. The first sleeve can (1) include a first opening through which a first portion of a sternum strap associated with the backpack extends during use, and (2) be configured to be positioned about an entire circumference of the first shoulder strap such that the first sleeve covers the first shoulder strap along a length of the first shoulder strap between a first end portion of the first shoulder strap and a second end portion of the first shoulder strap opposite the first end portion of the first shoulder strap. The apparatus also comprises a second sleeve having a length of between about 16 inches and about 20 inches, where the second sleeve is configured to be removably secured to the second shoulder strap. The second sleeve (1) includes a second opening different than the first opening through which a second portion of the sternum strap associated with the backpack and different than the first portion of the sternum strap extends during use, and (2) can be configured to be positioned about an entire circumference of the second shoulder strap such that the second sleeve covers the second shoulder strap along a length of the second shoulder strap between a first end portion of the second shoulder strap and a second end portion of the second shoulder strap opposite the first end portion of the second shoulder strap.

DETAILED DESCRIPTION

To provide for the selective cleaning of the shoulder straps of a backpack, to extend the useful life of the shoulder straps, and/or to improve the structural integrity of the shoulder straps, a removable, elongate fabric (i.e., membrane) sleeve can be coupled onto each of the shoulder straps. As the backpack is worn (e.g., by a hiker during a hike), most of the sweat, debris, and deodorant that would otherwise have been transferred onto the shoulder straps can instead be transferred onto the sleeve. The sleeve can then be removed, cleaned, and reattached onto the shoulder strap for reuse.

Figure 1:
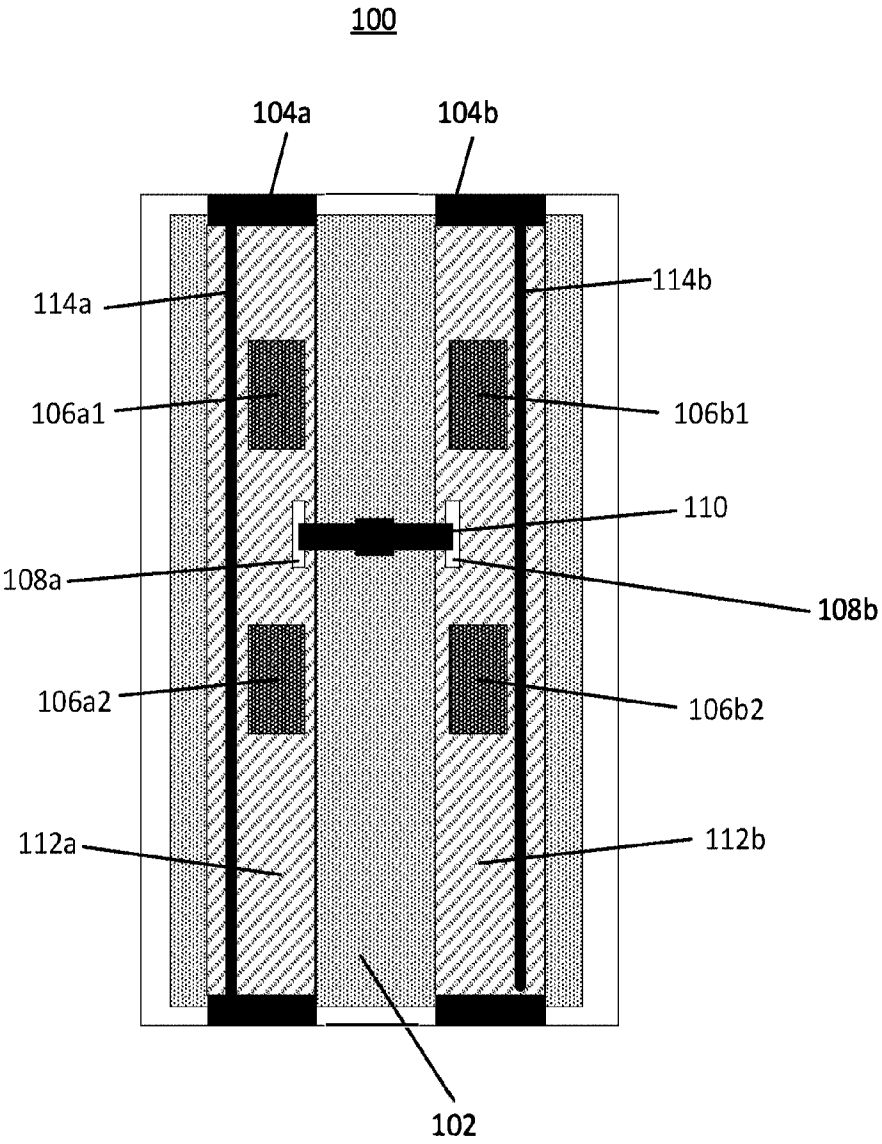
FIG. 1 shows an illustration of sleeves protecting the shoulder straps of a backpack, according to one embodiment.

FIG. 1 shows a back view of a backpack 100 including shoulder straps 104*a*, 104*b*, according to an embodiment. Elongate fabric sleeves 112*a*, 112*b* can each be removably secured onto respective shoulder straps 104*a*, 104*b*. The sleeves 112*a*, 112*b* can wrap around the entire circumference of the shoulder straps 104*a*, 104*b*, and have a length from a first portion (e.g., near the top) of the shoulder straps 104*a*, 104*b* to a second portion (e.g., near the bottom) of the shoulder straps 104*a*, 104*b*. The sleeves 112*a*, 112*b* have a substantially curved shape when wrapped around the shoulder straps 104*a*, 104*b*, in that portions of the sleeves 112*a*, 112*b* stretch around the edges of the shoulder straps 104*a*, 104*b*. In some implementations, the sleeves 112*a*, 112*b* can have a length of between about 16 inches and about 20 inches, or of less than about 16 inches, or of greater than about 20 inches, or can extend along at least about 75% of the length of the shoulder straps 104*a*, 104*b*, or of at least about 80% of the length of the shoulder straps 104*a*, 104*b*, or of at least about 85% of the length of the shoulder straps 104*a*, 104*b*, or of at least about 90% of the length of the shoulder straps 104*a*, 104*b*. In some implementations, the sleeves 112*a*, 112*b* can have a thickness less than at least one of 25 millimeters (mm), 20 mm, 15 mm, 10 mm, or 5 mm, In some implementations, the sleeves 112*a*, 112*b* can include a marking (e.g., text, arrow, etc.) indicating how the sleeves 112*a*, 112*b* are to be attached to the shoulder straps 104*a*, 104*b* (e.g., to prevent a sleeve from being attached to the wrong shoulder strap, to prevent a sleeve from being attached to a shoulder strap upside down, to prevent a sleeve from being attached to a shoulder strap inside out, etc.). In some implementations, the sleeves 112*a*, 112*b* can include woven materials, knitted materials, non-woven materials, non-knitted materials, or any combination thereof.

As used herein, the terms "substantially," "approximately," and "about," when referencing a numeric value, generally refer to plus or minus 10% of the value stated (e.g., "about 100" would include 90 to 110). The term "substantially," when referencing a non-numeric value, generally means "to a great or significant extent." For example, "substantially curved" can refer to a shape that approximates a curve but may not be perfectly symmetrical or curvilinear.

The sleeves 112*a*, 112*b* can each have closures 114*a*, 114*b* extending along the entire length or substantially the entire length of the sleeves 112*a*, 112*b* to secure the sleeves 112*a*, 112*b* onto the shoulder straps 104*a*, 104*b* during use, and to remove the sleeves 112*a*, 112*b* from the shoulder straps 104*a*, 104*b* when not in use (e.g., for cleaning). For example, in some implementations, the closures 114*a*, 114*b* may extend along at least about 75% of the entire length of the sleeves 112*a*, 112*b*, or of at least about 80% of the entire length of the sleeves 112*a*, 112*b*, or of at least about 85% of the entire length of the sleeves 112*a*, 112*b*, or of at least about 90% of the entire length of the sleeves 112*a*, 112*b*. The closures 114*a*, 114*b* can include one or more closure mechanisms, such as a zipper closure, a hook-and-loop closure (also referred to herein as a hook-and-pile closure, e.g., Velcro®), a snap closure, a magnet closure, or a button closure. One or more closures (e.g., closures 114*a*, 114*b*) can serve to keep a sleeve (e.g., sleeves 112*a*, 112*b*) in place on a shoulder strap (e.g., shoulder straps 104*a*, 104*b*) despite experiencing the expected/typical forces involved with the wear and usage of a backpack (e.g., backpack 100), while also being removable/re-attachable. In that context, a closure extending along "substantially the entire length" of a sleeve can be implemented, for example, as a first closure portion (e.g., a snap closure, magnet closure, button closure, or hook-and-pile closure) near an upper portion of a sleeve and a second closure portion (e.g., a snap closure, magnet closure, button closure, or hook-and-pile closure) near a lower portion of the sleeve, while the remaining portions above/below/between the first and second closures do not have closures. Of course, in other implementations, additional closure portions can be used, such as a third closure portion between the first and second closure portions.

Although not shown in FIG. 1, the sleeves 112*a*, 112*b* can also have fasteners to secure the sleeves 112*a*, 112*b* onto the shoulder straps 104*a*, 104*b* by fastening the fasteners from the sleeves 112*a*, 112*b* to complementary fasteners from to the shoulder straps 104*a*, 104*b*. The pairing of fasteners can prevent one or both ends of the sleeves 112*a*, 112*b* from sliding up and/or down along the shoulder straps 104*a*, 104*b*. The fasteners can include one or more types of fastener, such as buckle, hook, zipper, magnet, hook-and-loop, button, or snap type fasteners. Any appropriate number of fasters can be used per a sleeve, such as one (e.g., extending along the entire length of the sleeve or substantially the entire length of the sleeve), two (e.g., one faster near the top of the sleeve and another fastener near the bottom of the sleeve), three (e.g., a first fastener near the top of the sleeve, a second faster near the middle of the sleeve, and a third faster near the bottom of the sleeve), four (e.g., a first fastener near the top of the sleeve, a second faster near the upper-middle of the sleeve, a third fastener near the bottom-middle of the sleeve, and a fourth faster near the bottom of the sleeve), etc.

Although not shown in FIG. 1, in an embodiment, an interior portion of a sleeve (i.e., in contact with the shoulder strap) can be made of a first type of material/group of materials, and the exterior portion of the sleeve (i.e., not in contact with the shoulder strap) can be made of a second type of material/group of materials different than the first type. For example, the interior portion can be made of a material that provides more friction between the interior portion of the sleeve and associated shoulder strap (e.g., to decrease the likelihood of the sleeve slipping against the shoulder strap), while the exterior portion can be made of a (different) material than the interior portion (e.g., to soak sweat). As another example, the interior portion can be made of a waterproof or water-resistant material (e.g., rubber, polyvinyl chloride, polyurethan, silicone elastomer, fluoropolymer, wax, wool, cotton canvas, nylon, polyester, etc.,), and the exterior portion can be made of a non-waterproof or non-water-resistant material (e.g., cotton). As another example, the interior portion can be made of a non-waterproof or non-water-resistant material, and the exterior portion can be made of a waterproof or water-resistant material.

Additionally or alternatively, in some implementations, an interior portion of the sleeve can include a first portion made of a first type of material/group of materials, and a second portion made of a second type of material/group of materials different than the first type. For example, an interior portion of the sleeve near the top of the backpack 100 can be made of a first type of material/group of materials, and an interior portion of the sleeve near the bottom of the backpack 100 can be made of a second type of material/group of materials different than the first type.

Additionally or alternatively, in some implementations, an exterior portion of the sleeve can include a first portion made of a first type of material/group of materials, and a second portion made of a second type of material/group of materials different than the first type. For example, an exterior portion of the sleeve in contact with an armpit area of the wearer of the backpack 100 can be made of a first type of material/group of materials, and an exterior portion of the sleeve not in contact with the armpit area of the wearer of the backpack 100 can be made of a second type of material/group of materials different than the first type.

The sleeves 112*a*, 112*b* can also include pockets 106*a*1, 106*a*2, 106*b*1, 106*b*2. The pockets 106*a*1, 106*a*2, 106*b*1, 106*b*2 can define a storage volume that is accessible by a wearer of the backpack 100. The pockets 106*a*1, 106*a*2, 106*b*1, 106*b*2 can each have any size and/or shape, such as a smaller pocket for storing a phone or snacks, and a larger pocket for storing a water bottle. The pockets 106*a*1, 106*a*2, 106*b*1, 106*b*2 can be open pockets, or closable pockets (e.g., waterproof pockets). Closeable pockets can be closeable via one or more types of closure mechanism, such as a zipper closure, a hook-and-loop closure, a snap closure, a magnet closure, or a button closure. The pockets 106*a*1, 106*a*2,

106b1, 106b2 can include material that is the same or different than the material included in the sleeves 112a, 112b. The pockets 106a1, 106a2, 106b1, 106b2 can be see through, not see through, or a combination thereof.

The sleeves 112a, 112b can also include openings 108a, 108b for a sternum strap 110 to fit through. The openings 108a, 108b can be always open, or can have a closure to close the openings 108a, 108b when not in use. In the latter case, the closure mechanism can include one or more of a zipper closure, a hook-and-loop closure, a snap closure, a magnet closure, or a button closure. In a scenario where the sleeves 112a, 112b include impact absorbing pads, portions of the impact absorbing pads can also have openings that are aligned with openings 108a, 108b such that the sternum strap 110 can fit through both (1) openings 108a, 108b, and (2) openings at the impact absorbing pads. In some implementations, multiple openings can exist within a single sleeve (e.g., one or more additional openings located above and/or below openings 108a and/or 108b) so that a user of the backpack can choose to use the opening that is most conveniently located relative to the sternum strap. For example, although not shown in FIG. 1, if the location of the sternum strap 110 were adjustable (e.g., a user of the backpack 100 can slide the sternum strap 110 up or down to adjust the vertical location of the sternum strap 110 on the shoulder straps 104a, 104b), multiple openings existing within a single sleeve can allow the sternum strap 110 to be passed through an opening closest to the sternum strap 110 even if the location of the sternum strap 110 itself has changed.

Although the openings 108a, 108b in FIG. 1 are separate from the closures 114a, 114b, in some implementations, openings can be formed from gaps within the closures, as will be discussed later herein. Although not shown in FIG. 1, the sleeves 112a, 112b can include additional or alternative openings for straps other than the sternum strap 110. For example, the sleeves 112a, 112b can include openings near respective bottom portions for a waist belt (i.e., hip strap) to pass through.

The sleeves 112a, 112b can also include one or more elements to prevent the ends of the sternum strap 110, when detached, from swinging around. For example, although not shown in FIG. 1, bands (e.g., elastic bands) can be attached to the exterior of the sleeves 112a, 112b below and/or above the sternum strap 110 (e.g., resembling a bottomless pocket) such that a user of the backpack 100 can pass an end of the sternum strap 110 through the band and between an opening located between the bands and the sleeve. That way, since the ends of the sternum strap 110 are secured by the bands, the ends of the sternum strap 110 will move around much less compared to them not being secured by the bands (e.g., and not hit a wearer of the backpack 100 as the wearer moves around).

The sleeves 112a, 112b can also include one or more impact-absorbing pads (not shown) disposed within an interior of (e.g., within an interior volume defined by the sleeves 112a, 112b) and/or attached to at least a portion of each of the sleeves 112a, 112b, to provide cushion between the shoulder straps 104a, 104b and the shoulders of a wearer of the backpack 100. For example, in some implementations, one or more impact-absorbing pads can be enclosed by an outer layer (e.g., a fabric layer) of each of the sleeves 112a, 112b and thus form part of each of the sleeves 112a, 112b. In other implementations, one or more impact-absorbing pads can be mechanically coupled (e.g., glued, stitched, affixed via hook-and-loop) to each of the sleeves 112a, 112b.

The length of the sleeve 112a, 112b can vary. In some implementations, the length of the sleeve 112a, 112b is equal to the length of the shoulder strap 104a, 104b. In some implementations, the length of the sleeve 112a, 112b is enough to cover the portions of the shoulder strap 104a, 104b that are in contact with the wearer of the backpack 100, to cover the portions of the shoulder strap 104a, 104b that are in contact with one of the labrum, scapula, or clavicle of a wearer of the backpack 100, and/or to cover the portions of the shoulder strap 104a, 104b that are in contact with the shoulders of a wearer of the backpack 100. In some implementations, the length of the sleeve 112a, 112b is between about 16 inches and about 20 inches.

The sleeves 112a, 112b can be made of any of a wide variety of materials, including materials that are stain-resistant and/or durable against mechanical degradation. For example, in some implementations, the sleeves 112a, 112b can include at least one of: polyester, elastane, velour, stretchable terrycloth, spandex, Lycra®, cotton, neoprene, or nylon.

Optionally, the backpack 100 can also include a removable back panel 102. The removable back panel 102 can be attached to the back panel of the backpack 100. Sweat/debris can be transferred to the removable back panel 102 when in use (e.g., during a hike), and can detached from the backpack 100 when not in use (e.g., to clean). That way, rather than having to clean an entire backpack when the back panel is dirty, only the removable back panel 102 can be cleaned. The removable back panel 102 can be removably coupled onto a back panel portion of the backpack 100 via any appropriate coupling mechanism, such as via hook-and-loop, buttons, snaps, or zippers. Alternatively or in addition, the removable back panel 102 can be removably coupled to the sleeves 112a, 112b via any appropriate coupling mechanism, such as via hook-and-loop, buttons, snaps, zippers, stitching, or glue.

In one or more implementations, the backpack 100 is a hiking backpack. In one or more implementations, the backpack 100 has a carrying capacity that is: between 15-30 liters, greater than 30 liters, between 30-50 liters, or greater than 50 liters. In one or more implementations, the backpack 100 includes a sternum strap 110 and/or a waist belt (not shown in FIG. 1). The sternum strap 110 and/or waist belt can provide extra support to a wearer of the backpack 100, which can be useful for hikes. In one or more implementations, the backpack 100 is a waterproof backpack (e.g., coated with waterproof material), and the sleeves 112a, 112b and removable back panel 102, which can be cleaned, may or may not be waterproof. In one or more implementations, the backpack is a smart-backpack including electronic components (e.g., a battery) that are not waterproof. In some implementations, the shoulder straps 104a, 104b are not removable from the backpack 100. In some implementations, the backpack 100 is not machine washable.

In one or more implementations, the sleeves 112a, 112b are glow-in-the-dark or include at least one glow-in-the-dark portion. In one or more implementations, the sleeves 112a, 112b are reflective or include at least one reflective portion.

Figure 2B:
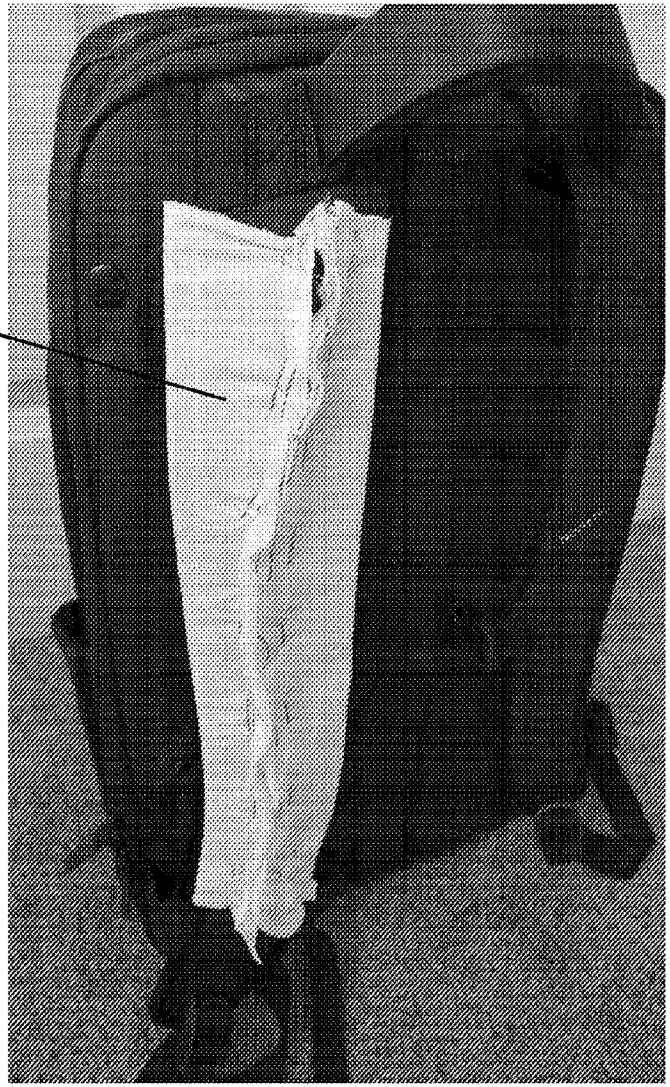
FIGS. 2A and 2B show two views of a sleeve protecting a shoulder strap of a backpack, according to one embodiment.
Figure 2A:
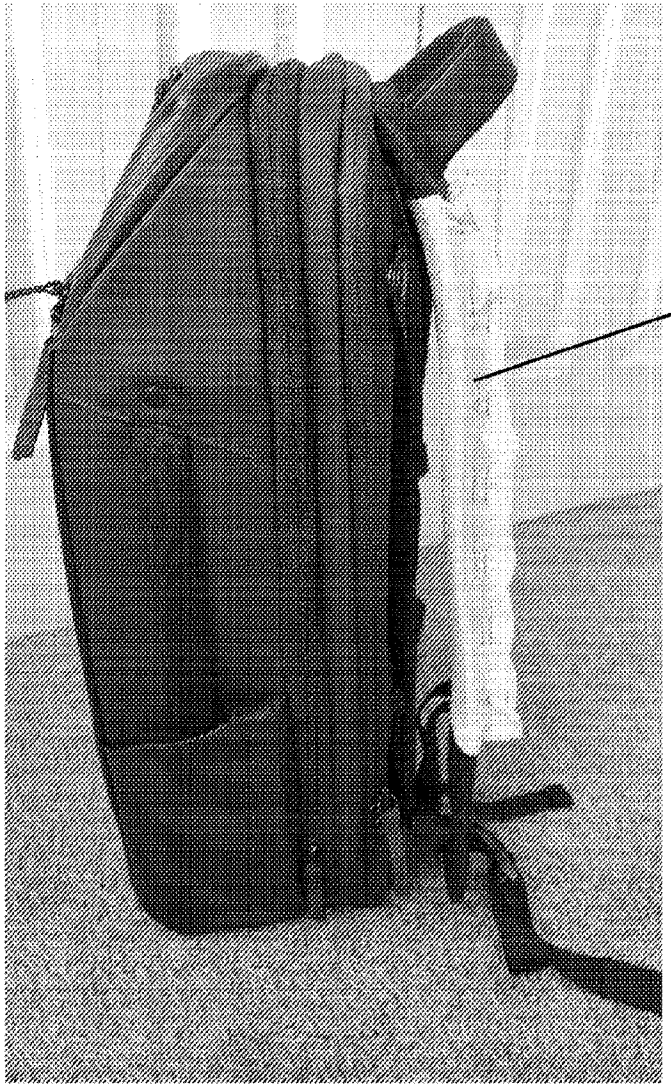

FIG. 2A shows a side view of a backpack 200 with a sleeve 202 coupled onto a shoulder strap. FIG. 2B shows a perspective rear view of the backpack 200. As can be seen in FIGS. 2A and 2B, the sleeve 202 is curved and wraps around the shoulder strap. The sleeve 202 stays wrapped around the shoulder strap via hook-and-loop closures (e.g., Velcro®) that couple a first end of the sleeve 202 with a second end of the sleeve 202. As a user wears the backpack 200, the sleeve 202 is able to prevent the shoulder strap from making contact with sweat/deodorant. After a user is done wearing the backpack 200, they can take the sleeve 202 off the shoulder strap for cleaning by separating the hook-and-loop portions.

Figure 3B:
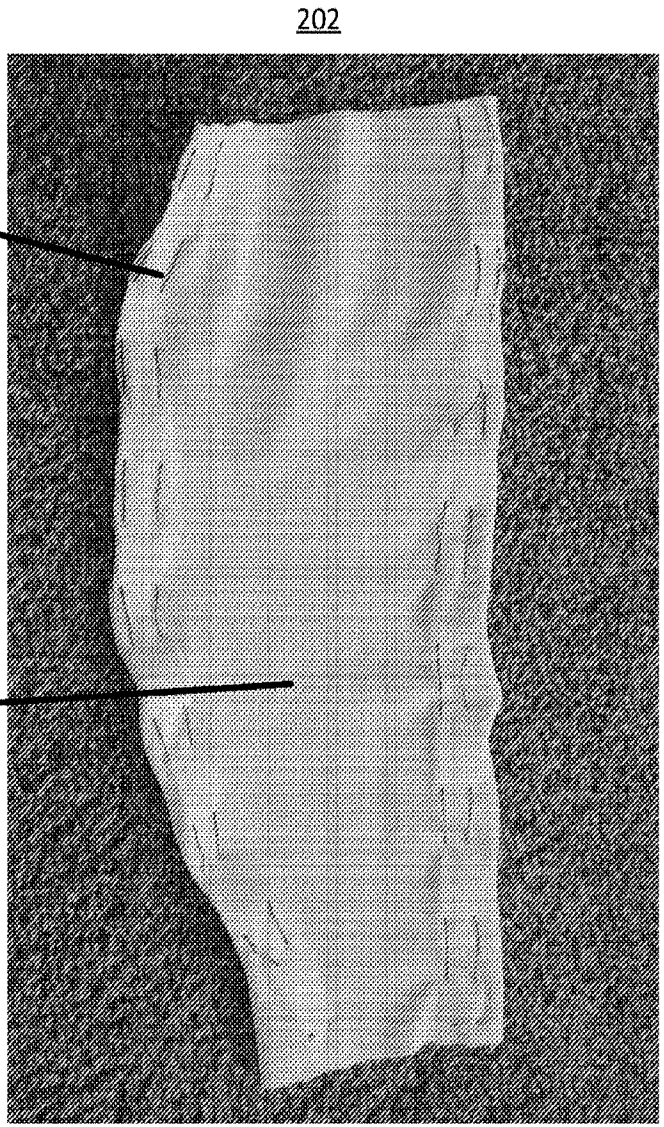
FIGS. 3A and 3B show two views of a sleeve for protecting a shoulder strap of a backpack, according to one embodiment.
Figure 3A:
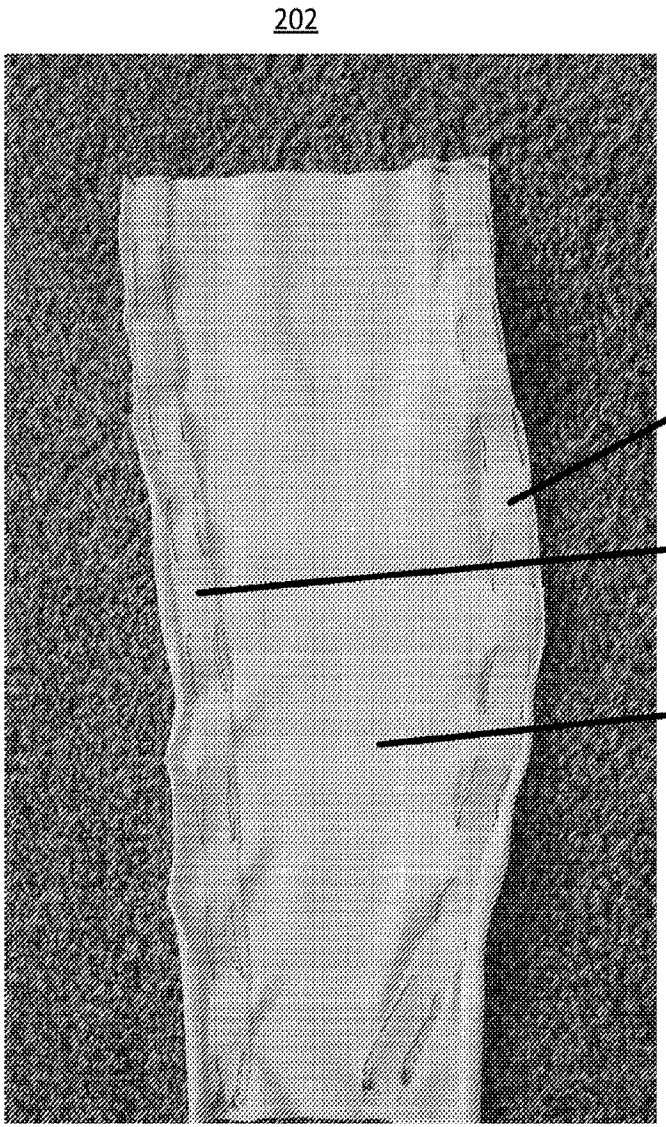

FIGS. 3A and 3B show additional images of the sleeve 202 from FIGS. 2A and 2B. FIG. 3A shows an interior view of the sleeve 202 (i.e., the portion that will be in contact with the shoulder strap 204). As can been seen, the sleeve is made up of a fabric 208. Along a first side of the fabric 208 is a hook 212 portion of the hook-and-loop closure, and along a second side of the fabric 208 is a loop 206 portion of the hook-and-loop closure. FIG. 3B shows an exterior view of the sleeve 202 (i.e., the portion that will be receive sweat/deodorant/debris during use). The sleeve 202 includes stitching 210, which was used to fasten the hook 212 and loop 206 to their respective portions of the fabric 208. As can be seen in FIG. 3A, the stitching 210 creates an alternating pattern in the hook 211 portion and the loop 206 portion, where stitching 210 is present in some portions but not other portions. That way, when the hook 211 portion and loop 206 portion are combined (where stitched portions of the hook 211 combine with stitched portions of the loop 206, and non-stitched portions of the hook 211 combine with non-stitched portions of the loop 206), gaps can form within the closure near the hook 211 portions and loop 206 portions with stitching 210. That way, a sternum strap can fit through any of these gaps. Of course, such gaps can be created using other types of closures too, such as buttons, snaps, buckles, etc.

Of course, it can be appreciated that FIGS. 2A, 2B, 3A, and 3B show one example configuration, and other configurations can exist. For example, in one or more implementations, one of the hook 212 or loop 206 is facing outwards from the interior portion of the sleeve 202, and the other one of the hook 212 or loop 206 is facing outwards from the exterior portion of the sleeve at an opposite side, allowing the portion of the sleeve with the hooks to lay over the portion of the sleeve with the loops (in contrast with FIGS. 2A and 2B, where the hook and loop portions of the sleeve combined together to form a protruding ridge shape). In other implementations, the hook 212 and loop 206 can be replaced with a different type of closure, such as buttons and buttonholes.

Figure 4B:
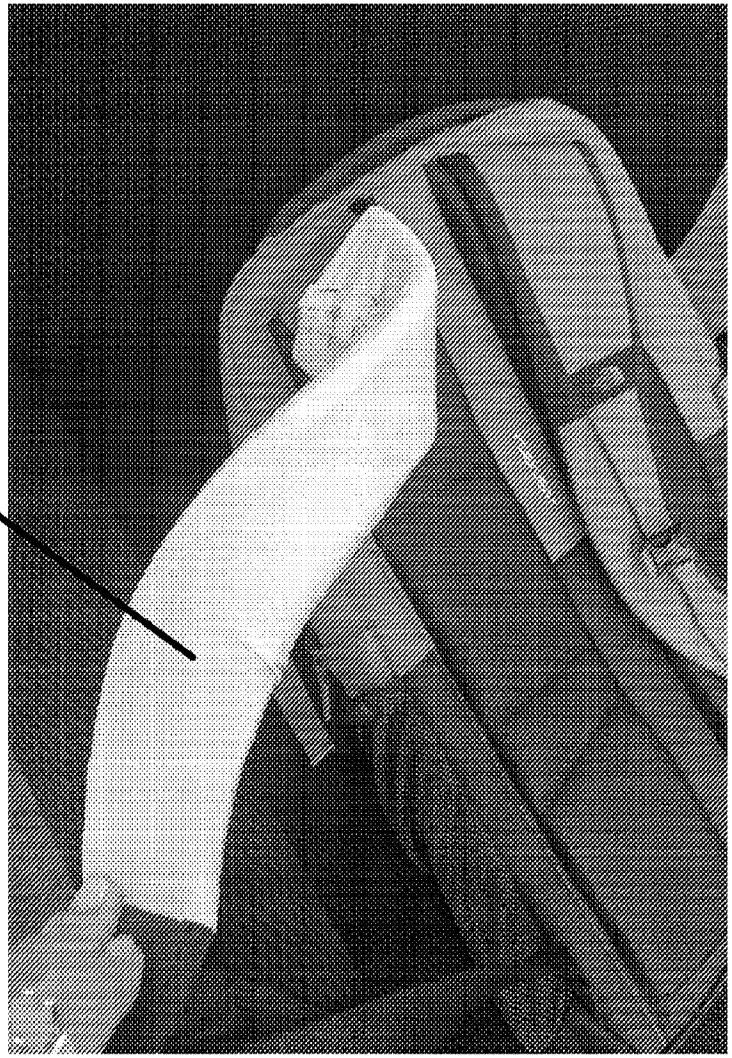
FIGS. 4A and 4B show two views of a sleeve protecting a shoulder strap of a backpack, according to one embodiment.
Figure 4A:
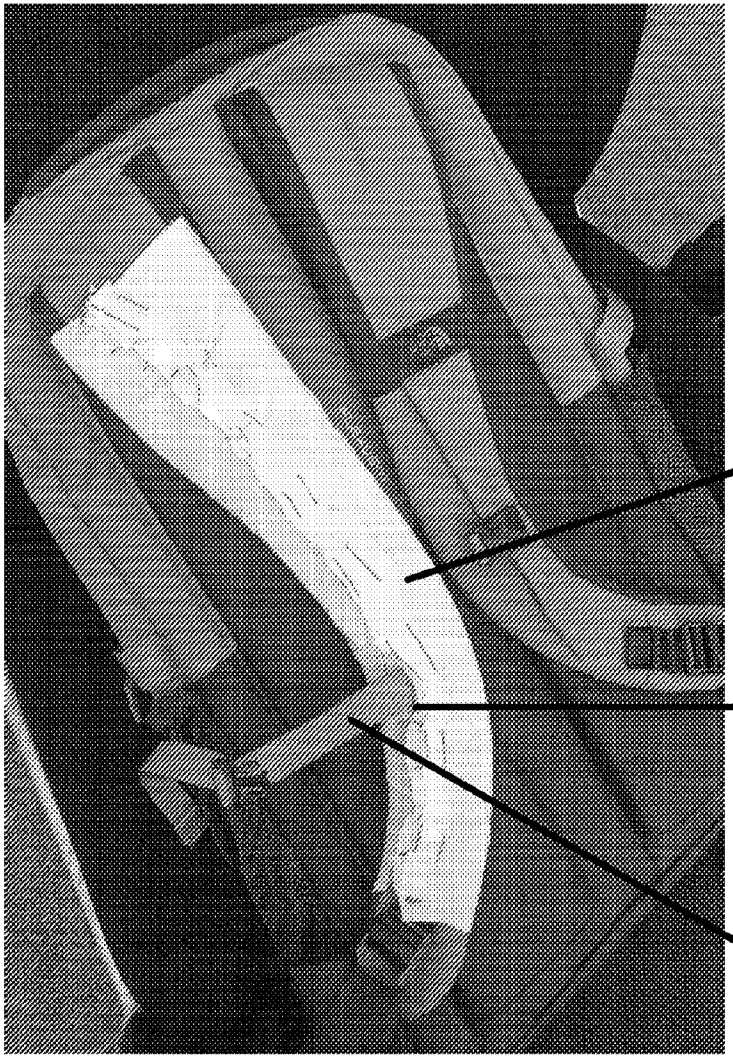

FIGS. 4A and 4B shows additional examples of a backpack 400 having a sleeve 402 coupled onto one of its shoulder straps. As can be seen, the sleeve 402 fully wraps around the backpack's 400 shoulder strap. A smooth surface of the sleeve is facing towards the back panel of the backpack 400 when in use, and the closure is facing away from the back panel of the backpack 400 when in use. In addition, the sleeve 402 includes an opening 404, thereby allowing a sternum strap 406 to pass through the opening 404 while the sleeve 402 (optionally including padding along its entire length on one or both sides of the shoulder strap) extends along most or all of the length of the shoulder strap, thereby maximizing the protected surface of the shoulder strap and the amount of cushion provided to the wearer. Unlike FIG. 1, where the openings 108*a*, 108*b* are separate from the closures 114*a*, 114*b*, the opening 404 shown in FIG. 4A is incorporated with the closure. In other words, the sternum strap 404 can pass through a gap between portions of the closure (e.g., a gap in the hook-and-loop connection, a gap between adjacent button/snap closures). Furthermore, note that the sleeve 402 extends to portions of the shoulder strap that are at, above, and below the sternum strap 406. This can be useful because it is not uncommon for sweat/deodorant/debris to contact portions of the shoulder strap that are at, below, and above the sternum strap 406. In contrast, the usage of a first sleeve covering a portion above the sternum strap and/or a separate, second sleeve covering a portion below the sternum strap, can leave portions of the shoulder strap near the sternum strap exposed, thereby increasing the likelihood of that shoulder strap getting dirty.

Although the discussions above related to a backpack with two shoulder straps, it can be appreciated that the embodiments discussed herein can be applied to other devices, such as a purse, sling bag, or seatbelt.

In one embodiment, an apparatus for attachment to a backpack comprises: an elongate fabric sleeve having a length of between about 16 inches and about 20 inches, the elongate fabric sleeve having an opening defined therein. through which a sternum strap of the backpack extends during use. The opening can be defined by one or more closures (e.g., as discussed above), or may be formed within a surface of the elongate fabric sleeve (e.g., using an eyelet). The elongate fabric sleeve is configured to be removably secured to a shoulder strap of a backpack, and is configured to be positioned about an entire circumference of the shoulder strap such that the fabric sleeve covers the shoulder strap along a length of the shoulder strap between a first end portion of the shoulder strap and a second end portion of the shoulder strap opposite the first end portion of the shoulder strap.

Some implementations further comprise: a pocket membrane that, in combination with at least a portion of the elongate fabric sleeve, defines a storage volume that is accessible by a wearer of the backpack, the pocket membrane mechanically coupled to one of a zipper closure, a hook-and-loop closure, a snap closure, a magnet closure, or a button closure.

In some implementations, the fabric sleeve includes at least one of: polyester, elastane, velour, stretchable terrycloth, spandex, Lycra®, cotton, neoprene, or nylon.

In some implementations, the elongate fabric sleeve includes a first portion in contact with the shoulder strap, and a second portion opposite from the first portion not in contact with the shoulder strap, the first portion including a first material (e.g., at least one of: polyester, elastane, velour, stretchable terrycloth, spandex, Lycra®, cotton, neoprene, or nylon) and the second portion including a second material (e.g., at least one of: polyester, elastane, velour, stretchable terrycloth, spandex, Lycra®, cotton, neoprene, or nylon) different than the first material.

In some implementations, the elongate fabric sleeve has a substantially curved shape.

Some implementations further comprise an impact-absorbing pad disposed within an interior of the elongate fabric sleeve.

Some implementations further comprise an impact-absorbing pad disposed within an interior of, and mechanically coupled to, the elongate fabric sleeve.

In some implementations, the elongate fabric sleeve includes one of a zipper closure, a hook-and-loop closure, a snap closure, a magnet closure, or a button closure to secure the elongate fabric sleeve to the backpack when the elongate fabric sleeve is positioned about the shoulder strap during use.

In some implementations, the elongate fabric sleeve includes a fastener portion configured to mate to a fastener portion of the backpack, to secure the elongate fabric sleeve to the backpack when the elongate fabric sleeve is positioned about the shoulder strap during use.

In some embodiments, an apparatus comprises: a backpack including a first shoulder strap and a second shoulder strap; a first sleeve having a length of between about 16 inches and about 20 inches and configured to be removably secured to the first shoulder strap, the first sleeve (1) including a first opening through which a first portion of a sternum strap associated with the backpack extends during use, and (2) configured to be positioned about an entire circumference of the first shoulder strap such that the first sleeve covers the first shoulder strap along a length of the first shoulder strap between a first end portion of the first shoulder strap and a second end portion of the first shoulder strap opposite the first end portion of the first shoulder strap; and a second sleeve having a length of between about 16 inches and about 20 inches and configured to be removably secured to the second shoulder strap, the second sleeve (1) including a second opening different than the first opening through which a second portion of the sternum strap associated with the backpack and different than the first portion of the sternum strap extends during use, and (2) configured to be positioned about an entire circumference of the second shoulder strap such that the second sleeve covers the second shoulder strap along a length of the second shoulder strap between a first end portion of the second shoulder strap and a second end portion of the second shoulder strap opposite the first end portion of the second shoulder strap.

Some implementations further comprise a fabric pocket mechanically coupled to one of the first sleeve or the second sleeve, the fabric pocket defining a storage volume that is accessible by a wearer of the backpack, the fabric pocket including one of a zipper closure, a hook-and-loop closure, a snap closure, a magnet closure, or a button closure.

In some implementations, each of the first sleeve and the second sleeve includes at least one of: polyester, elastane, velour, stretchable terrycloth, spandex, Lycra®, cotton, neoprene, or nylon.

In some implementations, the backpack includes a back panel, and optionally further includes a removable back panel removably secured to the back panel.

In some implementations, each of the first sleeve and the second sleeve has a substantially curved shape.

Some implementations further comprise an impact-absorbing pad disposed within an interior of one of the first sleeve or the second sleeve.

Some implementations further comprise an impact-absorbing pad disposed within an interior of, and mechanically coupled to, one of the first sleeve or the second sleeve.

Some implementations further comprise an impact-absorbing pad disposed within an interior of, and mechanically coupled to, each of the first sleeve and the second sleeve.

In some implementations, at least one of the first sleeve or the second sleeve includes one of a zipper closure, a hook-and-loop closure, a snap closure, or a button closure for attachment to the backpack when the at least one of the first sleeve or the second sleeve about the associated shoulder strap during use.

In some implementations, at least one of the first sleeve or the second sleeve includes a first fastener portion configured to mate to a second fastener portion of the backpack, for attachment to the backpack.

In some implementations, each of the first sleeve and the second sleeve includes an associated first fastener portion configured to mate to an associated second fastener portion of the backpack, for attachment to the backpack.

All combinations of the foregoing concepts and additional concepts discussed here (provided such concepts are not mutually inconsistent) are contemplated as being part of the subject matter disclosed herein. The terminology explicitly employed herein that also may appear in any disclosure incorporated by reference should be accorded a meaning most consistent with the particular concepts disclosed herein.

The skilled artisan will understand that the drawings primarily are for illustrative purposes, and are not intended to limit the scope of the subject matter described herein. The drawings are not necessarily to scale; in some instances, various aspects of the subject matter disclosed herein may be shown exaggerated or enlarged in the drawings to facilitate an understanding of different features. In the drawings, like reference characters generally refer to like features (e.g., functionally similar and/or structurally similar elements).

To address various issues and advance the art, the entirety of this application (including the Cover Page, Title, Headings, Background, Summary, Brief Description of the Drawings, Detailed Description, Embodiments, Abstract, Figures, Appendices, and otherwise) shows, by way of illustration, various embodiments in which the embodiments may be practiced. The advantages and features of the application are of a representative sample of embodiments only, and are not exhaustive and/or exclusive. Rather, they are presented to assist in understanding and teach the embodiments, and are not representative of all embodiments. As such, certain aspects of the disclosure have not been discussed herein. That alternate embodiments may not have been presented for a specific portion of the innovations or that further undescribed alternate embodiments may be available for a portion is not to be considered to exclude such alternate embodiments from the scope of the disclosure. It will be appreciated that many of those undescribed embodiments incorporate the same principles of the innovations and others are equivalent. Thus, it is to be understood that other embodiments may be utilized and functional, logical, operational, organizational, structural and/or topological modifications may be made without departing from the scope and/or spirit of the disclosure. As such, all examples and/or embodiments are deemed to be non-limiting throughout this disclosure.

Also, no inference should be drawn regarding those embodiments discussed herein relative to those not discussed herein other than it is as such for purposes of reducing space and repetition. For instance, it is to be understood that the logical and/or topological structure of any combination of any program components (a component collection), other components and/or any present feature sets as described in the Figures and/or throughout are not limited to a fixed operating order and/or arrangement, but rather, any disclosed order is exemplary and all equivalents, regardless of order, are contemplated by the disclosure.

In addition, the disclosure may include other innovations not presently described. Applicant reserves all rights in such innovations, including the right to embodiment such innovations, file additional applications, continuations, continuations-in-part, divisionals, and/or the like thereof. As such, it should be understood that advantages, embodiments, examples, functional, features, logical, operational, organizational, structural, topological, and/or other aspects of the disclosure are not to be considered limitations on the disclosure as defined by the embodiments or limitations on equivalents to the embodiments. Depending on the particular desires and/or characteristics of an individual and/or enterprise user, database configuration and/or relational model, data type, data transmission and/or network framework, syntax structure, and/or the like, various embodiments of the technology disclosed herein may be implemented in a manner that enables a great deal of flexibility and customization as described herein.

All definitions, as defined and used herein, should be understood to control over dictionary definitions, definitions in documents incorporated by reference, and/or ordinary meanings of the defined terms.

As used herein, in particular embodiments, the terms "about" or "approximately" when preceding a numerical value indicates the value plus or minus a range of 10%. Where a range of values is provided, it is understood that each intervening value, to the tenth of the unit of the lower limit unless the context clearly dictates otherwise, between the upper and lower limit of that range and any other stated or intervening value in that stated range is encompassed within the disclosure. That the upper and lower limits of these smaller ranges can independently be included in the smaller ranges is also encompassed within the disclosure, subject to any specifically excluded limit in the stated range. Where the stated range includes one or both of the limits, ranges excluding either or both of those included limits are also included in the disclosure.

The indefinite articles "a" and "an," as used herein in the specification and in the embodiments, unless clearly indicated to the contrary, should be understood to mean "at least one."

The phrase "and/or," as used herein in the specification and in the embodiments, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the embodiments, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the embodiments, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of." "Consisting essentially of," when used in the embodiments, shall have its ordinary meaning as used in the field of patent law.

As used herein in the specification and in the embodiments, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the embodiments, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

While specific embodiments of the present disclosure have been outlined above, many alternatives, modifications, and variations will be apparent to those skilled in the art. Accordingly, the embodiments set forth herein are intended to be illustrative, not limiting. Various changes may be made without departing from the spirit and scope of the disclosure.

The invention claimed is:

1. An apparatus comprising:

a smart-backpack including an electronic component that is not waterproof;

an elongate fabric sleeve having a first end, a second end opposite from the first end, a length of between about 16 inches and about 20 inches, and an alternating pattern of stitching that defines a plurality of openings positioned between the first end and the second end, at least one opening from the plurality of openings configured to receive a sternum strap of the smart-backpack therethrough; and a pocket membrane that (1) in combination with at least a portion of the elongate fabric sleeve, defines a storage volume that is accessible by a wearer of the smart-backpack, and (2) is mechanically coupled to one of a zipper closure, a snap closure, a magnet closure, or a button closure, the elongate fabric sleeve configured to be removably secured to a shoulder strap of a smart-backpack, and configured to be positioned about an entire circumference of the shoulder strap such that the elongate fabric sleeve covers the shoulder strap along a length of the shoulder strap between a first end portion of the shoulder strap and a second end portion of the shoulder strap opposite the first end portion of the shoulder strap, the elongate fabric sleeve including (1) a first portion that is in contact with the shoulder strap and (2) a second portion opposite from the first portion that is not in contact with the shoulder strap, the second portion including (1) a first area made of a first material and (2) a second area that is different from the first area and made of a second material different than the first material.

2. The apparatus of claim 1, wherein the elongate fabric sleeve is glow-in-the-dark.

3. The apparatus of claim 1, further comprising an impact-absorbing pad disposed within an interior of, and mechanically coupled to, the elongate fabric sleeve.

4. The apparatus of claim 1, wherein the elongate fabric sleeve further includes at least one band configured to receive the sternum strap therethrough.

5. The apparatus of claim 1, wherein the first portion includes (1) a third area made of a third material and (2) a fourth area that is different from the third area and made of a fourth material different than the third material.

6. The apparatus of claim 1, wherein the smart-backpack is configured to be worn by a user, the first area is in contact with an armpit area of the user when the smart-backpack is worn by the user, and the second area is not in contact with the armpit area when the smart-backpack is worn by the user.

7. The apparatus of claim 1, wherein the elongate fabric sleeve includes at least one of: polyester, elastane, velour, stretchable terrycloth, spandex, neoprene, or nylon.

8. The apparatus of claim 1, wherein the elongate fabric sleeve includes at least two of: polyester, elastane, velour, stretchable terrycloth, spandex, neoprene, or nylon.

9. The apparatus of claim 1, wherein the elongate fabric sleeve includes at least three of: polyester, elastane, velour, stretchable terrycloth, spandex, neoprene, or nylon.

10. The apparatus of claim 1, wherein the elongate fabric sleeve includes at least four of: polyester, elastane, velour, stretchable terrycloth, spandex, neoprene, or nylon.

11. The apparatus of claim 1, wherein the elongate fabric sleeve includes at least five of: polyester, elastane, velour, stretchable terrycloth, spandex, neoprene, or nylon.

12. An apparatus, comprising:

a smart-backpack including an electronic component that is not waterproof, a first shoulder strap and a second shoulder strap, the first shoulder strap including a first portion of a sternum strap, the second shoulder strap including a second portion of the sternum strap configured to mate with the first portion of the sternum strap;

a first sleeve having a length of between about 16 inches and about 20 inches and configured to be removably secured to the first shoulder strap, the first sleeve (1) including an alternating pattern of stitching that defines a plurality of openings, at least one opening from the plurality of openings of the first sleeve configured to receive the first portion of the sternum strap therethrough during use, (2) configured to be positioned about an entire circumference of the first shoulder strap such that the first sleeve covers the first shoulder strap along a length of the first shoulder strap between a first end portion of the first shoulder strap and a second end portion of the first shoulder strap opposite the first end portion of the first shoulder strap, (3) including a first portion that (i) is in contact with the first shoulder strap, (ii) includes a first area made of a first material, and (iii) includes a second area that is different than the first area and made of a second material different than the first material and (4) including a second portion opposite from the first portion of the first sleeve that (i) is not in contact with the first shoulder strap, (ii) includes a third area made of a third material, and (iii) includes a fourth area that is different than the third area and made of a fourth material different than the third material;

a second sleeve having a length of between about 16 inches and about 20 inches and configured to be removably secured to the second shoulder strap, the second sleeve (1) including a plurality of openings, at least one opening from the plurality of openings of the second sleeve configured to receive the second portion of the sternum strap therethrough during use, (2) configured to be positioned about an entire circumference of the second shoulder strap such that the second sleeve covers the second shoulder strap along a length of the second shoulder strap between a first end portion of the second shoulder strap and a second end portion of the second shoulder strap opposite the first end portion of the second shoulder strap, (3) including a first portion that (i) is in contact with the second shoulder strap, (ii) includes a fifth area made of a fifth material, and (iii) includes a sixth area that is different than the fifth area and made of a sixth material different than the fifth material, and (4) including a second portion opposite from the first portion of the second sleeve that (i) is not in contact with the second shoulder strap, (ii) includes a seventh area made of a seventh material, and (iii) includes an eighth area that is different than the seventh area and made of an eighth material different than the seventh material; and a pocket membrane that (1) in combination with at least a portion of one of the first sleeve or the second sleeve, defines a storage volume that is accessible by a wearer of the smart-backpack, and (2) is mechanically coupled to one of a zipper closure, a snap closure, a magnet closure, or a button closure.

13. The apparatus of claim 12, wherein each of the first sleeve and the second sleeve includes at least one of: polyester, elastane, velour, stretchable terrycloth, spandex, neoprene, or nylon.

14. The apparatus of claim 12, wherein the smart-backpack includes a back panel, further comprising a removable back panel removably secured to the back panel.

15. The apparatus of claim 12, further comprising an impact-absorbing pad disposed within an interior of, and mechanically coupled to, one of the first sleeve or the second sleeve.

16. The apparatus of claim 12, further comprising an impact-absorbing pad disposed within an interior of, and mechanically coupled to, each of the first sleeve and the second sleeve.

17. The apparatus of claim 12, wherein the first sleeve is glow-in-the-dark, and the second sleeve is glow-in-the-dark.

18. The apparatus of claim 12, wherein each of the first sleeve and the second sleeve includes at least two of: polyester, elastane, velour, stretchable terrycloth, spandex, neoprene, or nylon.

19. The apparatus of claim 12, wherein each of the first sleeve and the second sleeve includes at least three of: polyester, elastane, velour, stretchable terrycloth, spandex, neoprene, or nylon.

20. The apparatus of claim 12, wherein each of the first sleeve and the second sleeve includes at least four of: polyester, elastane, velour, stretchable terrycloth, spandex, neoprene, or nylon.

* * * * *